US005720905A

United States Patent [19]

Ho

[11] Patent Number: 5,720,905

[45] Date of Patent: Feb. 24, 1998

[54] CLEANING APPARATUS WITH OZONE AND BUBBLE GENERATING MEANS

[75] Inventor: Hsi-Yin Ho, Taipei, Taiwan

[73] Assignee: Liu Chang International Co., Ltd., Taipei Hsieh, Taiwan

[21] Appl. No.: 769,487

[22] Filed: Dec. 18, 1996

[51] Int. Cl.[6] ..... B01F 3/04

[52] U.S. Cl. ..... 261/16; 261/122.1; 261/DIG. 42; 15/339; 134/102.1

[58] Field of Search ..... 261/122.1, 16, 261/DIG. 42; 15/320, 339; 134/102.1

[56] References Cited

U.S. PATENT DOCUMENTS

| | | | |
|---|---|---|---|
| 1,932,379 | 10/1933 | Ballentine | 261/DIG. 42 |
| 4,072,613 | 2/1978 | Alig | 261/DIG. 42 |
| 4,829,607 | 5/1989 | Huse | 261/DIG. 42 |
| 5,093,047 | 3/1992 | Zeppenfeld | 261/122.1 |
| 5,514,267 | 5/1996 | Machiya et al. | 261/DIG. 42 |

*Primary Examiner*—Tim R. Miles
*Attorney, Agent, or Firm*—Varndell Legal Group

[57] ABSTRACT

A cleaning apparatus including a housing holding an air pump, an ozone generator, a high voltage generator, a cooling fan and a bubble generator, wherein a mixing cylinder is connected between the air pump and an ozone output port of the ozonizer to mix ozone from the ozonizer with air from the air pump, permitting the mixture to be guided to the bubble generator for producing air bubbles when the bubble generator is put under water, the mixing cylinder including a stepped cylindrical body having a big diameter section connected to the air pump and a small diameter section longitudinally extended from the big diameter section and connected to the bubble generator, an air outlet at the periphery of the big diameter section, a pipe connected between the air outlet and an air input port of the ozonizer, an ozone inlet at the periphery of the small diameter section, a pipe connected between the ozone inlet and the ozone output port of the ozonizer, and an inside annular flange extended from one end of the small diameter section inside the big diameter section and spaced from the air outlet at a distance, for permitting compressed air from the air pump to be partially guided through the air outlet to the air input port of the ozonizer and partially guided to the small diameter section for mixing with ozone received from the ozonizer.

1 Claim, 7 Drawing Sheets

CLEANING APPARATUS WITH OZONE AND BUBBLE GENERATING MEANS

BACKGROUND AND SUMMARY OF THE INVENTION

The present invention relates to a cleaning apparatus with ozone bubble generating means suitable for cleaning vegetables, fruits, food, etc., as well as for cleaning and massaging the body or a part of the body.

Various bubble generating apparatus have been disclosed for generating air bubbles in water for cleaning vegetables, fruits, food, etc., and have appeared on the market. However, these apparatus can only generate air bubbles in water, they do not generate ozone for sterilizing things or removing bad smells from food, etc. There are also known cleaning apparatus with ozonizer. These apparatus commonly use an air pump to pump air into an ozonizer, for permitting oxygen to be converted into ozone by a high voltage generated from a high voltage generator. However, because compressed air is directly pumped into the ozonizer, the air pump bears much pressure. Therefore, the service life of the air pump is short. Another drawback of these ozone generating cleaning apparatus is their limited application range. Furthermore, because of high air pressure, the temperature of outputted ozone is high.

The present invention has been accomplished to provide a cleaning apparatus with bubble and ozone generating means which eliminates the aforesaid drawbacks. According to one aspect of the present invention, the cleaning apparatus comprises a housing holding an air pump, an ozone generator, a high voltage generator, a cooling fan and a bubble generator, wherein a mixing cylinder is connected between the air pump and an ozone output port of the ozonizer to mix ozone from the ozonizer with compressed air from the air pump, permitting ozone and air mixture to be guided to the bubble generator for producing air bubbles when the bubble generator is put under water, the mixing cylinder including a stepped cylindrical body having a big diameter section connected to the air pump and a small diameter section longitudinally extended from the big diameter section and connected to the bubble generator, an air outlet at the periphery of the big diameter section, a pipe connected between the air outlet and an air input port of the ozonizer, an ozone inlet at the peripery of the small diameter section, a pipe connected between the ozone inlet and the ozone output port of the ozonizer, and an inside annular flange extended from one end of the small diameter section inside the big diameter section and spaced from the air outlet at a distance, for permitting compressed air from the air pump to be partially guided through the air outlet to the air input port of the ozonizer and partially guided to the small diameter section for mixing with ozone received from the ozonizer. Because of the mixing effect of the mixing cylinder, the air pump bears less pressure, the pressure of outputted ozone is low. Therefore, the service life of the air pump is prolonged, and the temperature of outputted ozone is stable. According to another aspect of the present invention, the bubble generator is connected to the mixing cylinder to receive ozone and air mixture from it, having a porous cover plate with pores of diameter within 0.2–2 mm for producing air bubbles and ultrasonic waves for cleaning and sterilizing vegetables, fruits, food, etc. According to still another aspect of the present invention, the bubble generator can be put in a bathtub for producing bubbles for activating water quality and stimulating the circulation of blood. According to still another aspect of the present invention, a basin is mounted on the housing at the top to carry the bubble generator for convenient use in the kitchen or on a table, desk, etc. According to still another aspect of the present invention, the basin can be supported on a ground stand to carry the bubble generator in water, so that the apparatus can be used for cleaning and massaging the hands, the face, the legs, etc. According to still another aspect of the present invention, the bubble generator can be detached from the apparatus, permitting the output port of the mixing cylinder to be directly connected to an air conditioner, air purifier, an air conduit, etc., to supply ozone contained air to a particular space for purifying the air.

DETAILED DESCRIPTION OF THE PREFERRED EMBODIMENT

Figure 1:
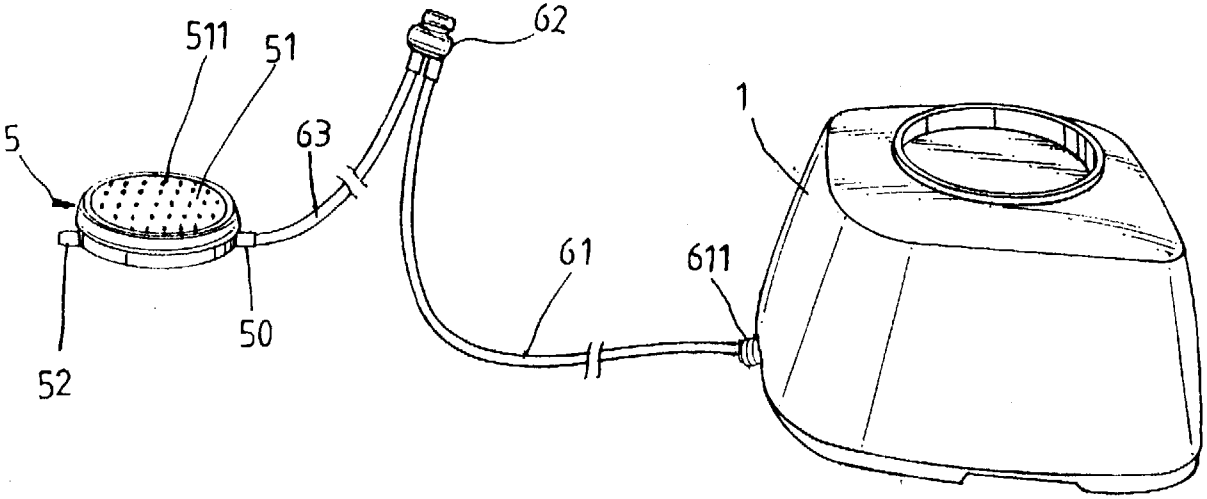
FIG. 1 is an elevational view of a cleaning apparatus according to the present invention.
Figure 2:
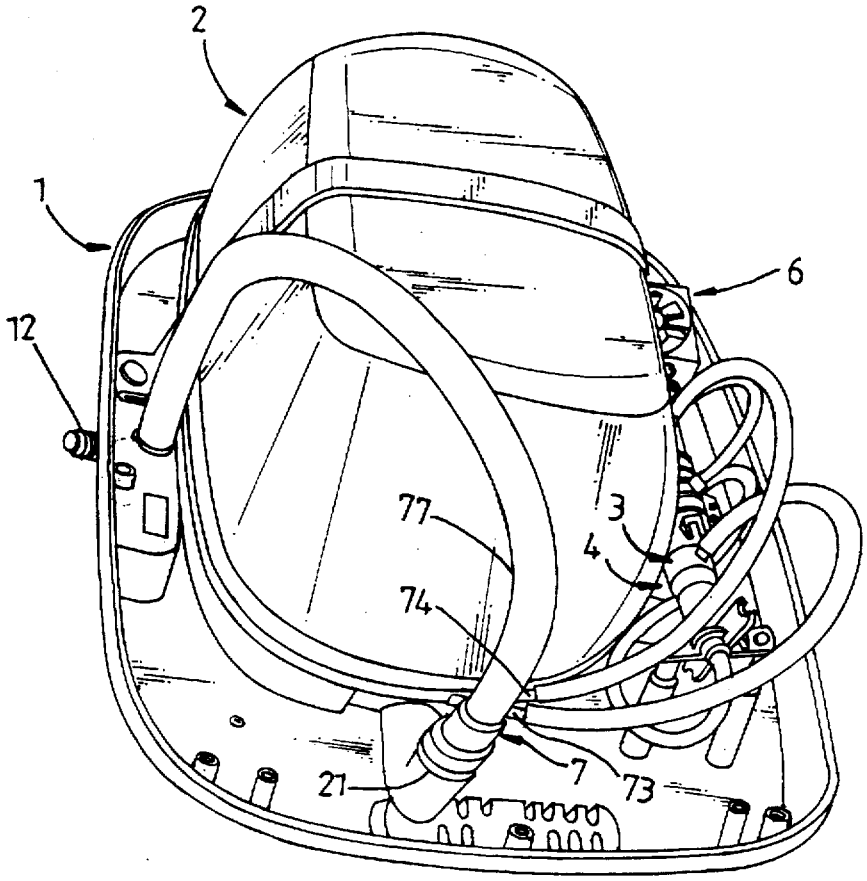
FIG. 2 shows the internal arrangement of the housing according to the present invention.

Referring to FIGS. 1 and 2, a cleaning apparatus in accordance with the present invention, is generally comprised of a housing 1, an air pump 2, an ozonizer 3, a high voltage generator 4, a bubble generator 5, a fan 6, a mixing cylinder 7, an air guide tube 61, a throttle valve 62, and an air supply tube 63.

Referring to Figures from 3 to 7 and FIGS. 1 and 2 again, the housing 1 holds the air pump 2, the ozonizer 3, the high voltage generator 4 and a fan 6 on the inside. The high voltage generator 4 is connected to the ozonizer 3, and controlled to discharge a high voltage for converting oxygen into ozone. The ozonier 3 comprises an air intake pipe 31 through which air is forced into the ozonizer 3, and an air outlet pipe 32 for output of ozone. The fan 6 is controlled to cause currents of air for dissipating heat. The bubble generator 5 is a container covered with a porous cover plate 51, which has a plurality of pores 511 of diameter within 0.2–2 mm, having an air inlet connector 50 to which the air supply pipe 63 is connected for guiding air into the bubble generator 5, and an air outlet connector 52. When the bubble generator 5 is put under water, air immediately escapes out of the bubble generator 5 through the pores 511 of the porous cover plate 51, therefore air bubbles are produced. Because the diameter of the pores 511 is within 0.2–2 mm, ultrasonic waves are produced when air passes through the pores 511 of the porous cover plate 51 under water. The air guide tube 61 has one end connected to the housing 1 by a quick connector 611, and an opposite end connected to the air supply pipe 63 through the throttle valve 62. An one-way valve is preferably installed in the air guide tube 61 between the quick connector 611 and the throttle valve 62 to limit the flowing direction of air, permitting air to pass from the housing 1 to the air supply pipe 63 through the throttle valve 62. The throttle valve 62 is connected between the air guide tube 61 and the air supply pipe 63 to regulate the flow of air passing through.

Figure 3:
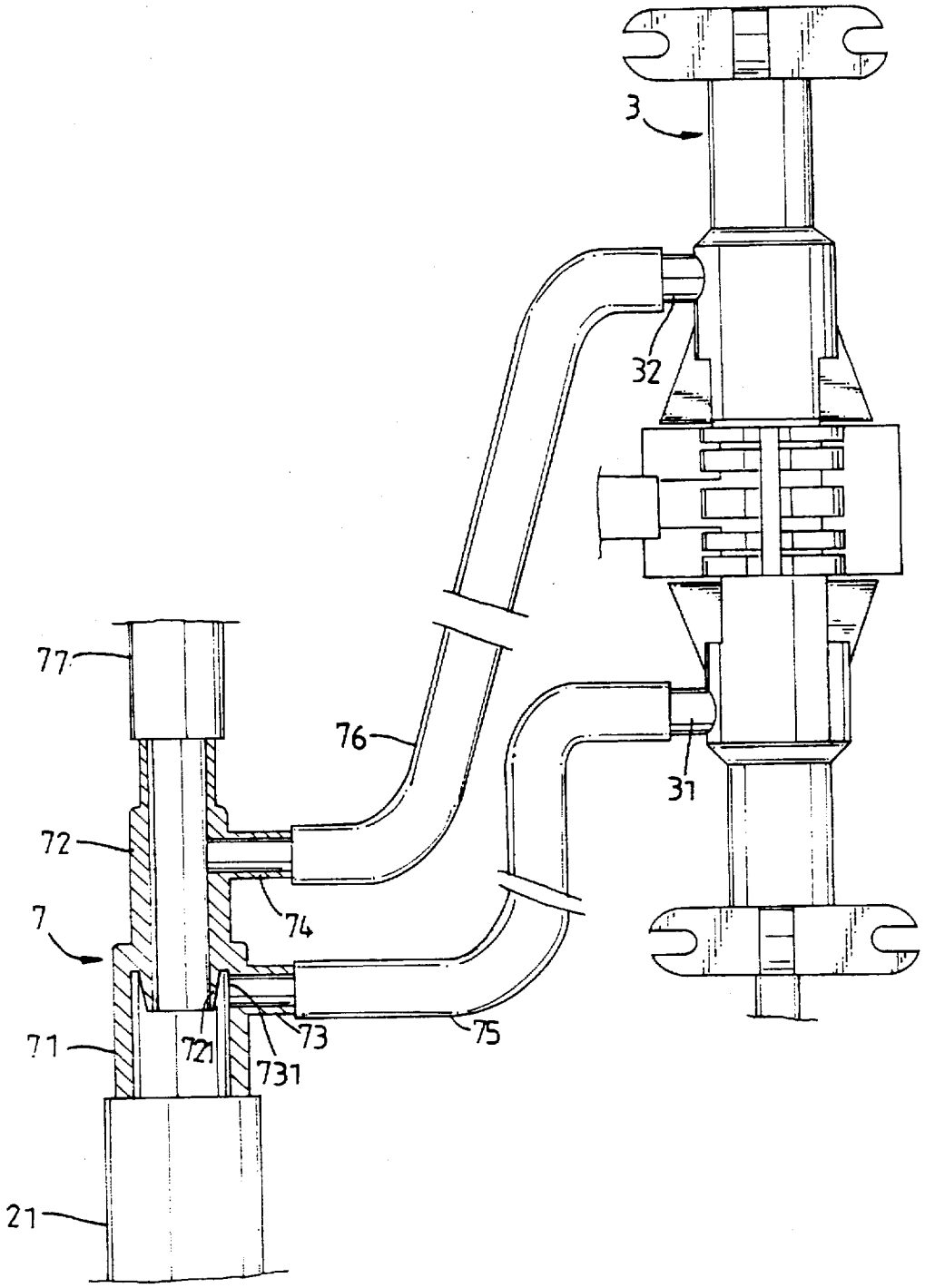
FIG. 3 is a partial view in an enlarged scale of the present invention, showing the connection between the mixing cylinder and the ozonizer.

The mixing cylinder 7 comprises a stepped cylindrical body having a big diameter section 71 connected to the output port 21 of the air pump 2 and a small diameter section 72 longitudinally extended from the big diameter section 71, an air guide tube 77 having one end connected to one end of the small diameter section 72 remote from the big diameter section 71 and an opposite end connected to a connector 12 at the periphery of the housing 1 (see FIG. 3), an air outlet 73 at the periphery of the big diameter section 71, a pipe 75 connected between the air outlet 73 and the air intake pipe 31 of the ozonizer 3, an ozone inlet 74 at the periphery of the small diameter section 72, a pipe 76 connected between the ozone outlet pipe 32 of the ozonizer 3 and the ozone inlet 74 and an inside annular flange 721 extended from one end of the small diameter section 72 inside the big diameter section 71 and spaced from the inner end 731 of the air outlet 73. The connector 12 is connected to the quick connector 611 at one end of the air guide tube 61. When the air pump 2 is operated to pump air through the output port 21 to the big diameter section 71 of the mixing cylinder 7, compressed air partially passes through the air outlet 73 and the pipe 75 into the ozonizer 3 for permitting contained oxygen to be converted into ozone, and partially passes through the small diameter section 72 to the air guide tubes 77, 61. When air is forced into the ozonizer 3, contained oxygen is converted into ozone, and ozone thus generated is forced through the pipe 76 into the small diameter section 72 for mixing with the running flow of air. The ozone and air mixture is then forced to flow through the air guide tubes 77, 61, the throttle valve 62 and the air supply pipe 63 into the bubble generator 5 via the connector 50. Because of the operation of the mixing cylinder 7, the air pump 2 bears less pressure. Therefore, the service life of the air pump 2 is relatively prolonged. Because compressed air is not fully driven from the air pump 2 into the ozonizer 3, less air pressure is given to the ozonizer. Therefore, the temperature of ozone from the ozonizer 3 is stable, and its purity is high.

Figure 6:
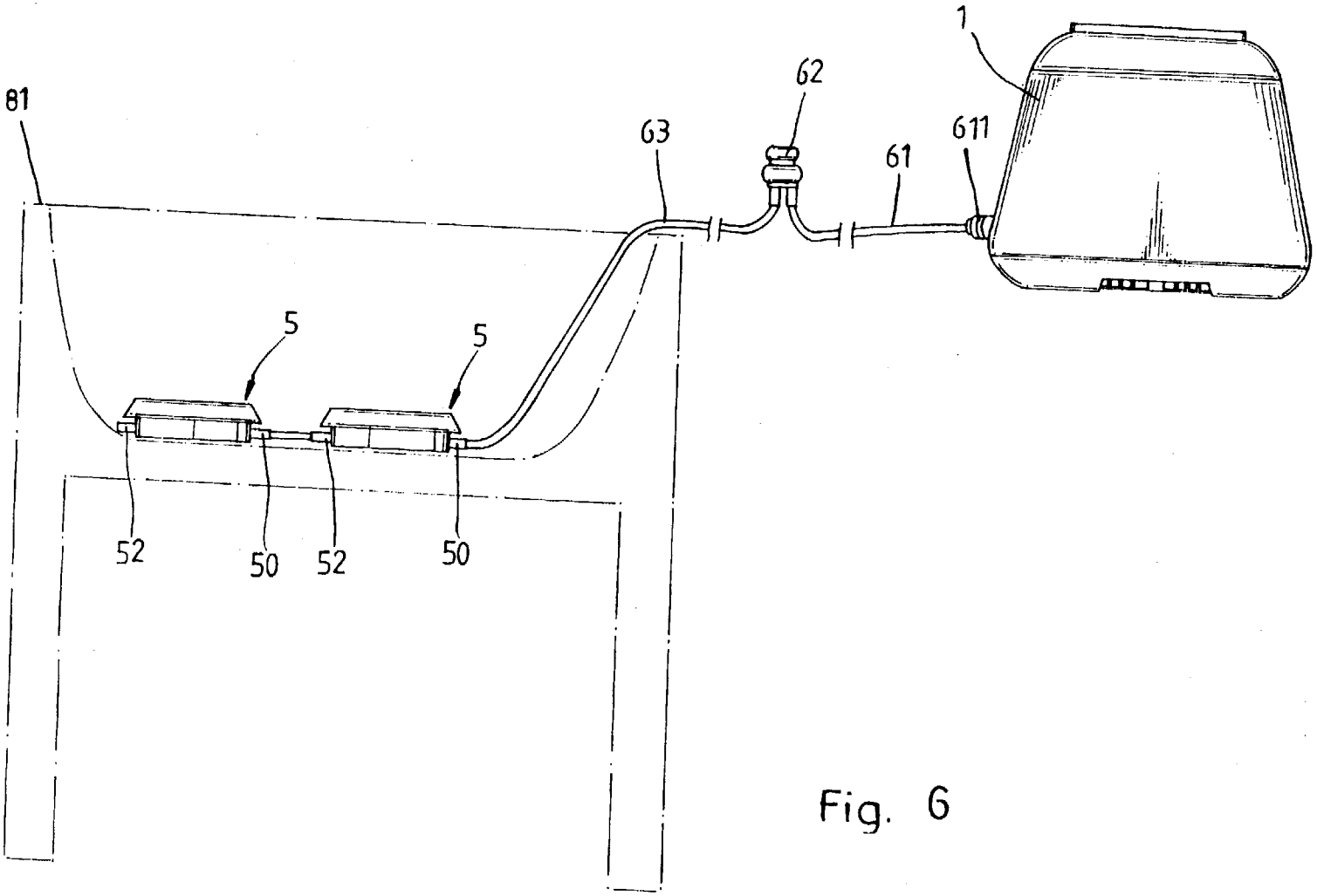
FIG. 6 is still another applied view of the present invention, showing the bubble generator put in a sink.

As indicated above, the air supply pipe 63 is connected to the connector 50 of the bubble generator 5, therefore ozone and air mixture is forced to flow from the mixing cylinder 7 to the bubble generator 5, and then to escape out of the bubble generator 5 through the pores 511 of the porous cover plate 51. When the bubble generator 5 is put under the water in a sink 81 (see FIG. 6), bubbles are produced to wash vegetables, fruits, etc., therefore residual pesticide in the vegetables, fruits, food, dishes, etc., is immediately oxidized by ozone, and fine dust is effectively removed by the vegetables, fruits, etc., by ultrasonic waves.

Figure 7:
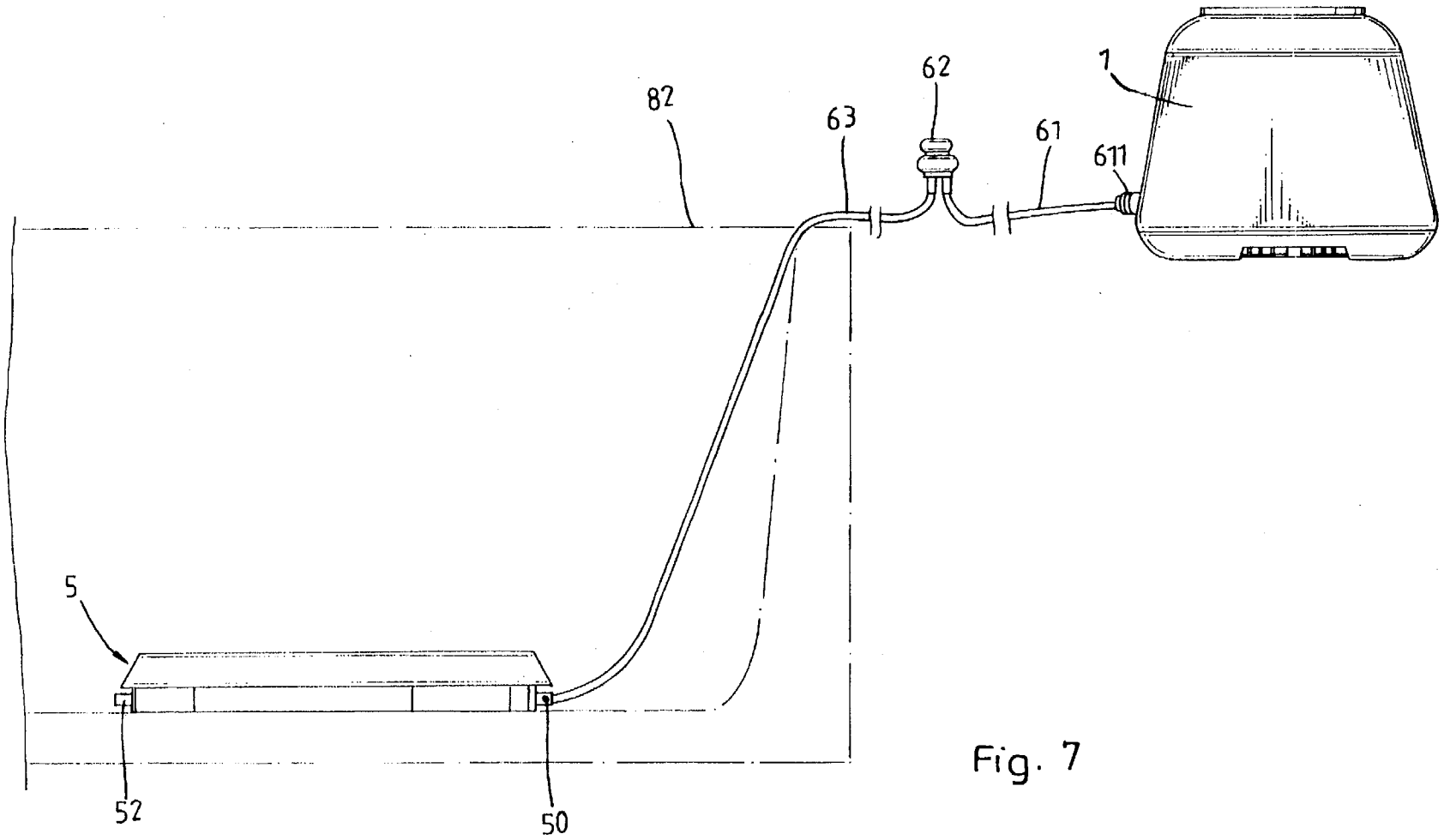
FIG. 7 is still another applied view of the present invention, showing the bubble generator put in a bathtub.

Referring to FIG. 7, the bubble generator 5 of the cleaning apparatus may be put under the water in a bathtub 82 to discharge air bubbles for cleaning and massaging the body, to stimulate the circulation of blood.

Normally, the air outlet connector 52 of the bubble generator 5 is stopped by stopper means. However, when necessary, two or more bubble generators 5 can be connected in series through the air inlet connector 50 and air outlet connector 52 (see FIG. 6).

Figure 4:
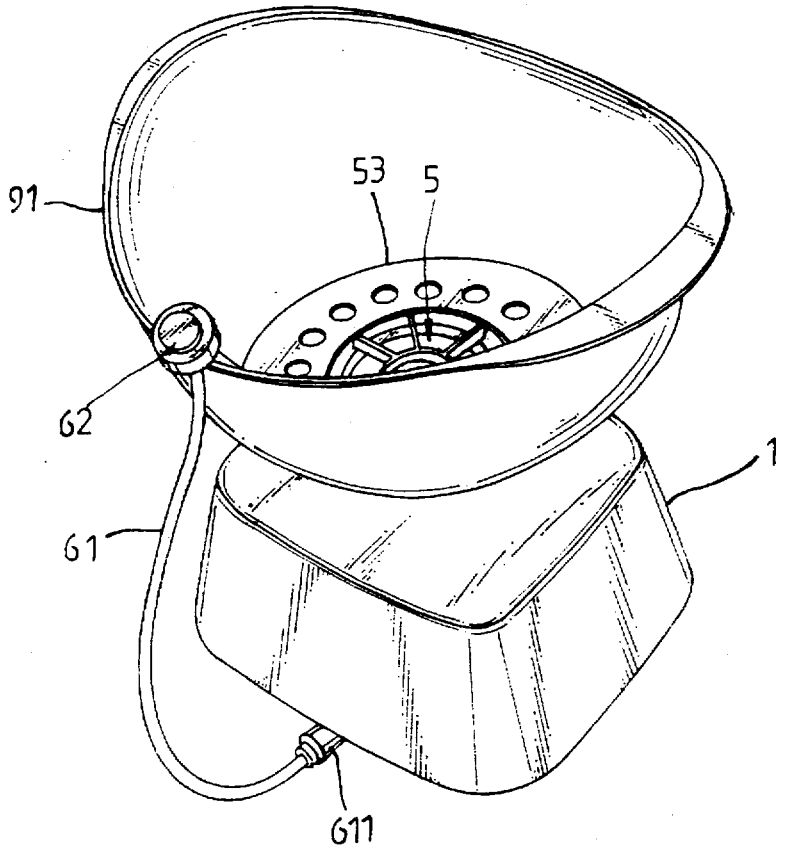
FIG. 4 is an applied view of the present invention, showing the bubble generator used with a basin.

Referring to FIG. 4, a basin 91 may be mounted on the housing 1 at the top for holding the bubble generator 5 in cleaning water, and a rack 53 may be mounted inside the basing 91 around the bubble generator 5 for carrying things to be washed. This design is convenient for use in a kitchen room, on a table, etc. put under the water in a basin 91 for cleaning and massaging the hands, the legs, or the face.

Figure 5:
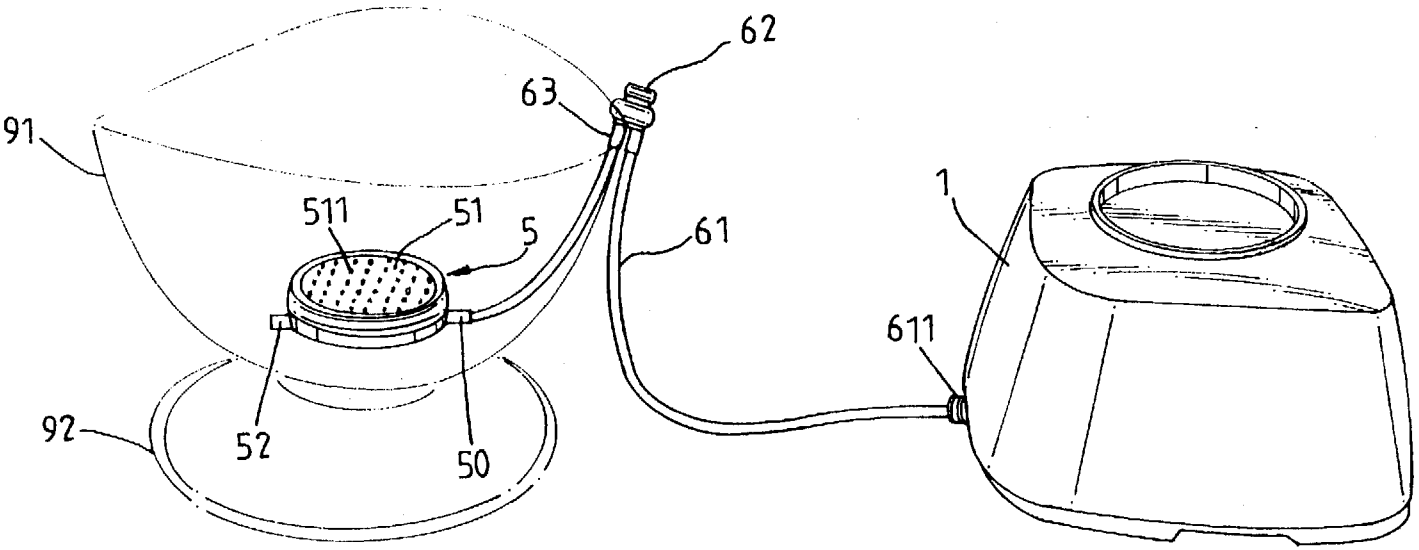
FIG. 5 is another applied view of the present invention, showing the bubble generator used with a basin supported on a stand.

Referring to FIG. 5, the stand 92 may be provided for supporting the aforesaid basin 91 on the ground, so that the apparatus can be used for cleaning and massaging the hands, the legs, or the face.

Furthermore, the bubble generator 5 can be disconnected from the air supply pipe 63, so that the air supply pipe 63 can be connected to an air conditioner, air purifier, an air conduit, etc., to supply ozone contained air to a particular space for purifying the air.

I claim:

1. A cleaning apparatus comprising:

a housing;

an air pump mounted inside said housing and having an air output port for output of compressed air;

an ozonizer controlled to generate ozone, said ozonier having an air input port adapted for receiving compressed air From the air output port of said air pump, and an air output port adapted for output of ozone;

a high voltage generator connected to said ozonizer and controlled to discharge a high voltage for converting oxygen into ozone;

a fan mounted inside said housing and controlled to cause currents of air for carrying heat away from the inside of said housing to the outside; and a bubble generator adapted for generating air bubbles when put under water, said bubble generator comprising an air input port connected to said air pump and the air output port of said ozonizer, and an air output port covered with a porous cover plate, which has a plurality of pores of diameter within 0.2–2 mm;

wherein a mixing cylinder is connected between the air output port of said air pump and the air output port of said ozonizer to mix ozone from said ozonizer with compressed air from said air pump, permitting ozone and air mixture to be guided to said bubble generator for producing air bubbles when said bubble generator is put under water, said mixing cylinder comprising a stepped cylindrical body having a big diameter section connected to the output port of said air pump and a small diameter section longitudinally extended from said big diameter section, an air guide tube having one end connected to one end of said small diameter section remote from said big diameter section and an opposite end connected to the air input port of said bubble generator through an air piping and a throttle valve in said air piping, an air outlet at the periphery of said big diameter section, a pipe connected between said air outlet and the air input port of said ozonizer, an ozone inlet at the periphery of said small diameter section, a pipe connected between said ozone inlet and the air output port of said ozonizer, and an inside annular flange extended from one end of said small diameter section inside said big diameter section and spaced from said air outlet at a distance for permitting compressed air from said air pump to be partially guided through said air outlet to the air input port of said ozonizer and partially guided to said small diameter section for mixing with ozone received from said ozonier.

* * * * *